US006866619B2

(12) United States Patent
Schermer

(10) Patent No.: US 6,866,619 B2
(45) Date of Patent: Mar. 15, 2005

(54) DISINTEGRATOR ROLL WITH A COATED ACCESSORY WIRE

(75) Inventor: Josef Schermer, Bergheim-Unterstall (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 10/267,903

(22) Filed: Oct. 9, 2002

(65) Prior Publication Data

US 2003/0100419 A1 May 29, 2003

(30) Foreign Application Priority Data

Oct. 11, 2001 (DE) ..... 101 50 431

(51) Int. Cl.[7] ..... A01B 29/00; B21D 53/00

(52) U.S. Cl. ..... 492/35; 492/30; 29/895.21; 29/895.31

(58) Field of Search ..... 492/30, 31, 33, 492/35, 36, 37, 43; 29/895.21, 895.211, 895.31; 19/97, 112, 114; 57/408; 76/25.1; 428/336, 409, 414

(56) References Cited

U.S. PATENT DOCUMENTS 3,387,338 A * 6/1968 Kanai et al. ..... 19/114
3,833,968 A 9/1974 Arai et al.
3,968,542 A * 7/1976 Hollingsworth ..... 19/97
4,044,427 A * 8/1977 Ankrom et al. ..... 19/97
4,352,224 A * 10/1982 Grimshaw et al. ..... 19/97
4,696,080 A 9/1987 Nakamura
5,164,236 A * 11/1992 Schmid ..... 57/408
5,428,949 A * 7/1995 Stahlecker ..... 19/114

FOREIGN PATENT DOCUMENTS

DE 2904841 8/1980
EP 1096043 B1 5/2001

OTHER PUBLICATIONS

German Patent Office Search Report, Feb. 19,2002.

* cited by examiner

*Primary Examiner*—Marc Jimenez
(74) *Attorney, Agent, or Firm*—Dority & Manning

(57) ABSTRACT

For an improvement of the coating of disintegrator rolls, an accessory wire in the area of a tooth base is coated with a reduced quantity of hard material granulate as compared to the coating on the tooth. With the proposed coating, the advantage is gained that a precoated accessory wire, without damaging the coating, can subsequently be wound on an accessory wire carrier.

15 Claims, 1 Drawing Sheet

DISINTEGRATOR ROLL WITH A COATED ACCESSORY WIRE

BACKGROUND

The present invention concerns a disintegrator roll for use in textile machines with a coated accessory wire, as well as a process for the manufacture of a coated accessory wire, especially made for a disintegrator.

In the state of the technology, it is known procedure to employ disintegrator rolls for the dissection of fiber bands into individual fibers. Such disintegrator rolls are installed, for example, in open-end spinning machines, that is, more specifically, open-end rotor spinning machines, for the stated purpose. The disintegrator rolls, to accomplish their function, are equipped with individual needles or teeth, whereby the teeth, for one example, can be created by stamping procedures from an accessory wire and subsequently the wire is wound upon the outer circumference of a wire carrier on a disintegrator roll.

The accessories or the teeth of the disintegrator roll are subjected to a high degree of abrasive attack, since in particular, fiber material of plastic, or for example, of unrefined cotton, presents an aggressive resistance to the teeth which are to penetrate into the fiber band.

From the state of the technology, disclosures have been made for the improvement of the abrasion resistance involving the coating of the accessory wire of disintegrator rolls. In the therewith connected procedure, a coating of granules of hard material are implanted on the surface of the accessory wire. This is carried out preferably by the deposition of a nickel coating on the surface of the accessory wire and at the same time, implanting hard material granules in the nickel layer. These granules, for example, could be diamond particulate.

The state of the technology also has made known, that before the winding of the accessory wire on the carrier of the disintegrator roll, the wire can be preshaped.

When this is done, the wire is so formed in the plane of the teeth, that it lies in a helical spiral, like a coil spring. As a result of this condition of the accessory wire, for the purposes of winding on the roll, it must not be bent further to any significant amount. A spalling of a previously deposited coating of, for example, nickel-diamond, can be avoided in this way.

In case of accessory wires for disintegrator rolls, which have been coated before being secured on the disintegrator roll, the disadvantage becomes evident, that upon the drawing up of the wire on the disintegrator roll, especially where the application of the wire is to be in a groove on the outside circumference of a wire carrier, for instance, as a result of clearance problems, a damage to the coating of the accessory wire can occur in the area of the base of the tooth.

This then leads to irregularities in the winding of the accessory wire in the groove of the wire carrier, which in turn brings about a deposition of fibers in the area of damage, whereby these fibers, by irregularly freeing themselves at irregular times, can cause disturbances in the formation of the yarn on the spinning machine.

In the state of the technology, this problem, up to this time, did not occur because the accessory wire was installed upon a wire carrier before the coating procedure, whereupon, a coating procedure took place which included the wire carrier, especially when a nickel-diamond coating was involved. By means of this procedure, it was possible to achieve a uniform coating in spite of the fact that it offered noticeable disadvantages, since the entire wire carrier, or possibly the entire disintegrator roll, had to be coated at the same time.

SUMMARY

A purpose of the present invention is to propose a disintegrator roll equipped with an accessory wire, which, before the affixing thereof on the wire carrier of the disintegrator roll, is already coated and the disadvantages of the state of the technology are avoided. A further purpose is to propose an accessory wire as well as a process, for coating the accessory wire for the disintegrator roll before winding the wire onto the disintegrator roll. Additional objects and advantages of the invention will be set forth in part in the following description, or may be obvious from the description, or may be learned through practice of the invention.

By means of the coating of the accessory wire in the area of the teeth, the achievement is advantageously made that the teeth receive a high resistance to abrasion and thereby the disintegrator roll becomes resistant to abrasive wear and can be applied to fiber band materials which are known to present severe abrasive wear on the teeth. Such a disintegrator roll does not need to be exchanged so often, which is economical, and an interruption of the production process is avoided. Because of the fact that, in accord with the invention, the area of the tooth base of the accessory wire, which is contiguous with the wire carrier, requires, at least partially, a smaller quantity of hard material relative to the area of the teeth, the advantage is gained that during the mounting of the accessory wire onto its carrier, no spalling of the of the hard-material granulate layer occurs. Thereby, the mounting of the wire need not be burdened with particularly undue skills, and beyond this, the clearances in the design of a groove on the wire carrier can be set with more freedom, which is economical in the production cost of the disintegrator roll.

Also, the prefabrication of the accessory wire does not have to be so precisely adjusted to the diameter of wire carrier upon which the accessory wire will eventually be wound. Because in the area of the base of the tooth, the quantity of the hard material granulate is at least reduced, or indeed can be completely eliminated, it is permissible to allow a relatively large elastic deformation of the accessory wire during its winding on a wire carrier without concern for spalling of the coating. This advantage is also achieved in the mounting of the accessory wire in a groove of a wire carrier.

Particularly advantageous is a version wherein the coating is designed with a lessened thickness, in order that the quantity of the hard material granulate may be reduced. The embodiment simplifies production and moreover, achieves an essentially more uniform spread of the coating.

In a further advantageous embodiment of the invention, provision is made for a reduction of the quantity of the hard material granulate by designing the coating to lessen in the direction toward the base of the tooth. In this way, a uniform transition between areas with a greater and a lesser quantity of hard material is attained.

In a particularly advantageous embodiment of the invention, hard material granulate is found to be entirely lacking in the area of the accessory wire which is in contact with the wire carrier.

By means of another coating of the accessory wire, this time with a corrosion protective layer, even the area of the tooth base which is not provided with a hard granulate coating is protected from corrosion. A corrosion protective coating for this service is thin enough, so that upon the mounting of the accessory wire, a spalling of the corrosion protection coating need not be feared. Particularly of advantage for this corrosion protection, is a nickel coating, since a nickel matrix must, in any case, be provided for coating with hard material granulate. When the corrosion protection layer is also a nickel coating, then the production process is once again simplified. Furthermore, the plain nickel coating allows the hard material granulate layer to be placed over it, without lending a negative effect to this granulate coating. By means of the use of an accessory wire, which is made in a helical coil, an otherwise certain spalling of a coating with hard material granulate upon the winding of the wire onto the wire carrier, is prevented. Moreover, in this way, the coating process is less expensive and can be complete more rapidly.

By means of the invented process, assurance is given that a versatile, installable accessory wire can be made, in the case of which no special measures are necessary in the mounting thereof. By this advantageous process, wherein one tooth base lies side by side against the base of the adjacent accessory wire, in order to exclude coating from the area between, or at least to diminish the quantity of hard material granulate, a simple measure is proposed whereby the invented process can be carried out economically, assuredly and quickly.

A particularly advantageous way in which to undertake the coating in accord with the invention is attained when the tooth bases and their adjacent tooth bases of the accessory wire are pressed against one another in the coating procedure. In this situation, the penetration of the coating liquid is prevented or reduced which allows control of the quantity of the deposited hard material granulate.

In an advantageous improvement, the accessory wire is prefabricated as a helical coil, because in this way any distortion of the accessory wire during its mounting operation is repressed. After the accessory wire has been coated with the hard material carrying layer, it is particularly of advantage to provide the accessory wire with another coating of corrosion preventive material. Thereby, those areas which have not been provided with a hard material granulate coating are now also protected against corrosion. Particularly advantageous for such a corrosion layer is a deposit of nickel, because this can easily be deposited on the accessory wire and can cause no disturbance with the already deposited coating with a hard material granulate additive. Advantageous for a hard material granulate for the coating of the teeth of the wire is, as mentioned, diamond particulate. Another advantageous material for the hard material granulate would be a silicon-carbide particulate.

In the following, the invention will be more fully explained with the aid of illustrated presentations.

DETAILED DESCRIPTION

Figure 1:
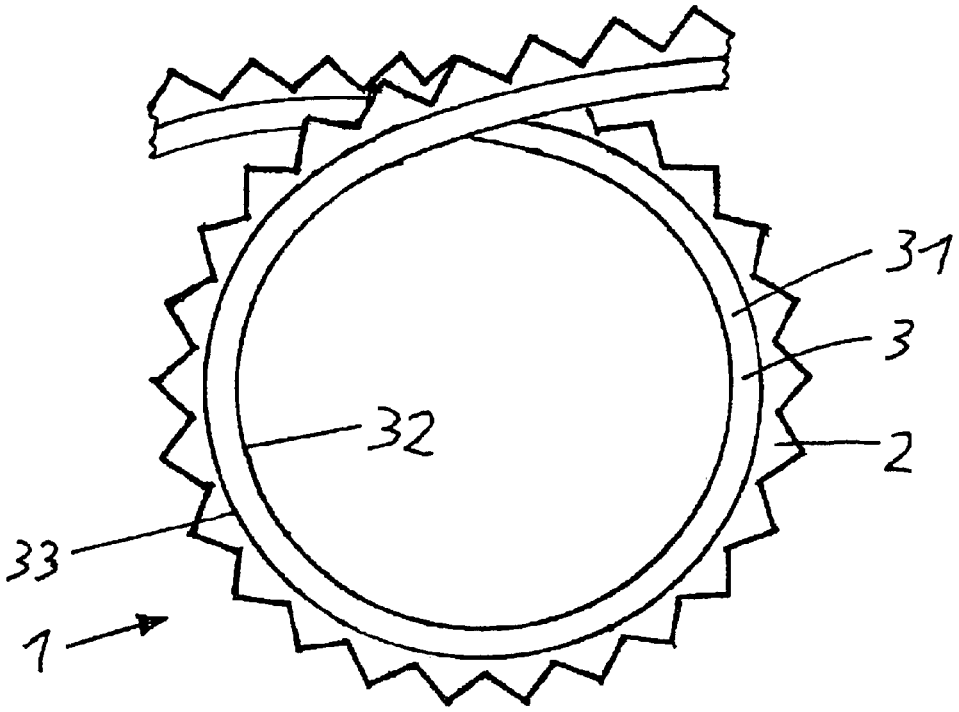
FIG. 1 illustrates a part of a prefabricated accessory wire for a disintegration roll.

Reference will now be made in detail to embodiments of the invention, examples of which are illustrated in the drawings. Each embodiment is provided by way of explanation of the invention, and not as a limitation of the invention. It is intended that the invention include modifications and variations to the embodiments described and illustrated herein.

FIG. 1 shows an accessory wire for the invented disintegrator roll. The accessory wire is helically preshaped. That is, the wire is curved in the plane of its teeth so that it assumes that helical configuration in which the teeth 2 project outward. The inside diameter of the accessory wire shaped in this manner is, approximately, the same as the outside diameter of the wire carrier upon which the accessory wire 1 is to be wound. The accessory wire, in this case, is only presented in a single wrap for sake of illustration. In practice, however, this would be seen as a unit of a plurality of windings. A limitation of the number of windings comes about principally in the ability to manipulate the wire, especially where coating is concerned.

The accessory wire 1 comprises its teeth 2 and a continuous base 3 for the teeth. The tooth base 3 possesses essentially a rectangular or square cross section (see FIG. 2), wherein the teeth, in the present example, extend themselves radially outward only on one side of their base 3. The teeth 2 can be varied in shape in accord with the requirements of the fiber material to be processed.

Thus, the teeth can be bowed in their form or smaller or greater in height than the designed radial protrusion of the tooth base. The shape of the teeth 2 is not of interest for the present invention.

In accord with the invention, the accessory wire of FIG. 1 is only coated in the area of its teeth 2. The area of the base 3 of the teeth 2, that is, both the side parts 31 as well as the oppositely situated bottom of the base 32, are not coated with the hard material granulate coating. The wire top area 33 which lies opposite to the bottom surface 32, that is to say, the area radially next to the teeth, as seen in FIG. 1, is provided with a layer carrying embedded hard material granules. The coating of this top area 33, in each case dependent upon the thickness of the applied hard material layer, can be done without problems since, in this area, the deformations upon the installation of the accessory wire are minimal, and the wire, due to its mounting, is not accessible for coating in these areas. The wire may be laid in a groove in the sidewall or the bottom of the carrier, Any damage to the coating, to all practical purposes, cannot occur in this oppositely situated base zone 33.

Figure 2:
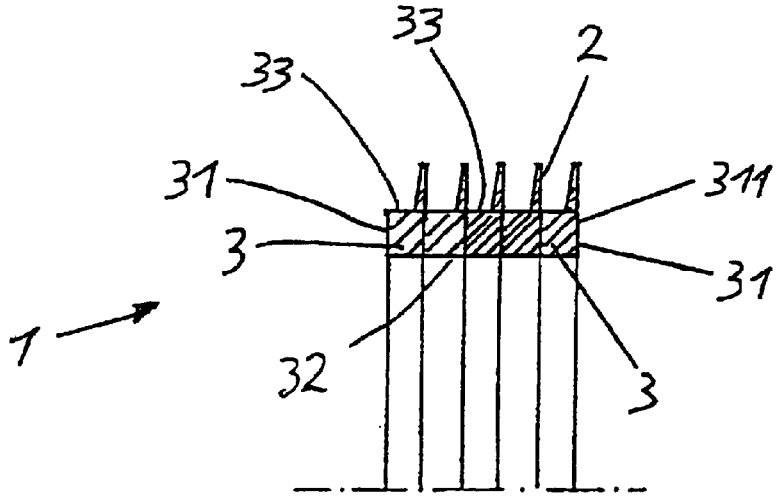
FIG. 2 is a view of a prefabricated accessory wire, the windings of which, are laid beside one another, in cross-section.

The prefabricated accessory wire, as it appears in FIG. 2, is shown in cross-section, so that the rectangular cross-section of the base of the tooth 3 is exhibited. As may be inferred from FIG. 2, the teeth 2 extend radially outward, whereby they lengthen the side surface 311 of the side part 31 of the tooth base 3. The axial extension of a tooth 2 measures approximately only about 30% of the area of the entire tooth base 3. Because of this, there arises the area 33 lying opposite to the area 32, which, like the teeth 2, is coated with a layer having implanted hard material granulate. The remaining surfaces of the tooth base, on the contrary, in a particularly advantageous manner, are free from the coating with hard material granulate. This is because the windings of the tooth wire 1 lie so close to one another, that upon the immersion of the so wound tooth wire in a coating bath, these surfaces 31 touch each other so closely, that in the bath, no liquid, or at least the hard material granulate itself, cannot penetrate between the tightly contacting surfaces.

In order to prevent that coating will extend to the bottom of the base 32, the accessory wire can be wound on a dummy roll for the coating procedure, so that the base bottom surface 32 does not come into contact with the liquid of the coating bath. Another possibility would be to close the ends of the present accessory wire, which is in the form of a tube, in order to prevent a penetration of coating fluid.

Besides the indicated possibilities, consideration can also be given to providing the tooth base 3 with a covering, namely in the form of a lacquer, so that the adherence of a coating thereon is not possible. In a particularly favorable embodiment of the invention, the accessory wire, after the coating with hard material granules, is subjected to a coating with a corrosion protective material, so that the area of the non-coated base of the teeth is corrosion protected.

The corrosion layer is especially favorably applied as a nickel layer, which, because of its negligible sensitivity to deformation, presents no problems during the laying of the accessory wire in a groove of the wire carrier. Other than is shown in FIG. 2, the accessory wire must be immersed in the coating bath with the windings exhibiting a distancing from one another. To this end, the accessory wire can be placed under tension and thereby stretched axially, or, spacers can be placed between the individual windings. For the coating with a corrosion protective layer, provision has advantageously been made to the effect that the area of the entire tooth base 3 is coated.

The here indicated embodiment examples are coated in such a manner, in accord with an especially favorable method of the invention, that the area in which the wire carrier comes in contact, remains free from hard material granules. The invention is, however, already characterized in that, in the relevant areas of the accessory wire, the quantity of the deposited hard material granules in the coating is reduced in relation to the quantity of the hard material granulate which is deposited in the area of the teeth. In the area of the teeth in one embodiment, the coating has a thickness of 25 $\mu$m for the layer with the implanted hard material granulate and the thickness of 5 $\mu$m is employed for the corrosion coating.

The invention gives consideration to the concept that, essentially, the quantity of the hard material in the coating, i.e., the abrasion resistance layer of the accessory wire, can lead to spalling. The thickness of the layer is, on this account, reduced and so much thinner than the danger of the spalling is significantly reduced.

It should be appreciated by those skilled in the art that modifications and variations can be made to the embodiments of the invention described herein without departing from the scope and spirit of the invention as set forth in the appended claims and their equivalents.

What is claimed is:

1. A disintegrator roll for use in textile machines, said disintegrator roll comprising:

an accessory wire wound around a wire carrier, said accessory wire having teeth extending from a tooth base, said tooth base mounted within said wire carrier;

a coating applied to said accessory wire, said coating comprising a layer of hard material granules: and wherein said coating is applied to said tooth base in areas in contact with said wire carrier in a reduced quantity as compared to the quantity of said coating applied to said teeth.

2. The disintegrator roll as in claim 1, wherein the thickness of said coating on said tooth base areas is less than the thickness of said coating on said teeth.

3. The disintegrator roll as in claim 2, wherein said tooth base comprises sides, a bottom surface, and a top surface from which said teeth extend, said sides corresponding to said tooth base areas having the reduced thickness of said coating.

4. The disintegrator roll as in claim 3, wherein said teeth have a side extending generally coplanar with one of said sides of said tooth base, said teeth sides have an increased thickness of said coating as compared to their respective coplanar tooth base.

5. The disintegrator roll as in claim 1, wherein at least portions of said tooth base comprise generally no hard material granules.

6. The disintegrator roll as in claim 1, wherein said accessory wire further comprises a coating of corrosion prevention material.

7. The disintegrator roll as in claim 6, wherein said corrosion prevention material comprises a nickel coating.

8. The disintegrator roll as in claim 1, wherein said accessory wire is prefabricated in a helical shape before said accessory wire is installed on said wire carrier.

9. An accessory wire used on textile machine disintegrator rolls, comprising:

a tooth base and teeth extending from said tooth base, said tooth base configured for mounting within a wire carrier on a disintegrator roll;

a coating applied to said accessory wire, said coating comprising a layer of hard material granules; and wherein said coating is applied to said tooth base in areas in contact with said wire carrier in a reduced quantity as compared to the a quantity of said coating applied to said teeth.

10. The accessory wire as in claim 9, wherein said tooth base comprises sides, a bottom surface, and a top surface from which said teeth extend, said sides corresponding to said tooth base areas having the reduced thickness of said coating.

11. The accessory wire as in claim 10, wherein said teeth have a side extending generally coplanar with one of said sides of said tooth base, said teeth sides having an increased thickness of said coating as compared to their respective coplanar tooth base.

12. The accessory wire as in claim 9, wherein at least portions of said tooth base have generally no coating of the hard material granules.

13. The accessory wire as in claim 9, wherein further comprising a coating of corrosion prevention material.

14. The accessory wire as in claim 13, wherein said corrosion prevention material comprises a nickel coating.

15. The accessory wire as in claim 9, wherein said accessory wire is prefabricated in a helical shape before said accessory wire is installed on said wire carrier.

* * * * *